US012247179B2

(12) United States Patent
Collett et al.

(10) Patent No.: US 12,247,179 B2
(45) Date of Patent: Mar. 11, 2025

(54) LUBRICATING COMPOSITIONS COMPRISING A NON-SILICONE ANTI-FOAMING AGENT

(71) Applicant: METSS Corp., Westerville, OH (US)

(72) Inventors: Brian R. Collett, Columbus, OH (US); Angela Theys, Kansas City, MO (US); Michelle Docter, Columbus, OH (US); Joseph Sanders, Powell, OH (US); Kenneth J. Heater, Delaware, OH (US)

(73) Assignee: METSS Corp., Westerville, OH (US)

( * ) Notice: Subject to any disclaimer, the term of this patent is extended or adjusted under 35 U.S.C. 154(b) by 0 days.

(21) Appl. No.: 18/065,878

(22) Filed: Dec. 14, 2022

(65) Prior Publication Data

US 2024/0199973 A1 Jun. 20, 2024

(51) Int. Cl.
*C10M 145/14* (2006.01)
*C10M 107/02* (2006.01)
(Continued)

(52) U.S. Cl.
CPC ..... *C10M 169/044* (2013.01); *C10M 107/02* (2013.01); *C10M 129/76* (2013.01); *C10M 133/12* (2013.01); *C10M 133/42* (2013.01); *C10M 137/04* (2013.01); *C10M 141/10* (2013.01); *C10M 145/14* (2013.01); *C10M 161/00* (2013.01); *C10M 2205/0206* (2013.01); *C10M 2207/283* (2013.01); *C10M 2209/084* (2013.01); *C10M 2215/26* (2013.01); *C10M 2215/30* (2013.01); *C10M 2223/041* (2013.01);
(Continued)

(58) Field of Classification Search
CPC ..... C10M 107/02; C10M 129/76; C10M 133/12; C10M 133/42; C10M 137/04; C10M 141/10; C10M 145/14; C10M 161/00; C10M 2205/0206; C10M 2207/283; C10M 2209/084; C10M 2215/26; C10M 2215/30; C10M 2223/041; C10N 2030/02; C10N 2030/06; C10N 2030/10; C10N 2030/12; C10N 2030/14; C10N 2030/18; C10N 2030/20
USPC ..... 508/257
See application file for complete search history.

(56) References Cited

U.S. PATENT DOCUMENTS 4,101,431 A 7/1978 Kuntschik
5,882,358 A * 3/1999 Smith ..... C10M 133/12 8/678
(Continued)

FOREIGN PATENT DOCUMENTS

WO 2009134656 11/2009
WO 2012047302 4/2012

OTHER PUBLICATIONS

International Search Report issued in PCT/US2011/001736, mailing date Apr. 10, 2013.
(Continued)

*Primary Examiner* — Prem C Singh
*Assistant Examiner* — Francis C Campanell
(74) *Attorney, Agent, or Firm* — Kern Kendrick, LLC; Benjamen E. Kern; Thomas Y. Kendrick

(57) ABSTRACT

Lubricating compositions are described, the lubricating compositions comprising a base oil component and an additive component, wherein the additive component comprises a non-silicone anti-foaming agent.

24 Claims, 12 Drawing Sheets

| Formulation | Durad | APAN | Irgamet 39 | Lubrizol 859 | Xiameter 200 | FB 152 | BYK 172 | Lubrizol 889D | Spectrasyn 10 | Spectrasyn 40 |
|---|---|---|---|---|---|---|---|---|---|---|
| METSS 2190-S | 1.000 | 1.000 | 0.100 | 0.100 | 0.002 | --- | --- | --- | 85.798 | 12.000 |
| 2190-S-8 | 1.000 | 1.000 | 0.100 | 0.100 | --- | 0.010 | --- | --- | 85.790 | 12.000 |
| 2190-S-9 | 1.000 | 1.000 | 0.100 | 0.100 | --- | 0.020 | --- | --- | 85.780 | 12.000 |
| 2190-S-10 | 1.000 | 1.000 | 0.100 | 0.100 | --- | 0.030 | --- | --- | 85.770 | 12.000 |
| 2190-S-11 | 1.000 | 1.000 | 0.100 | 0.100 | --- | 0.040 | --- | --- | 85.760 | 12.000 |
| 2190-S-12 | 1.000 | 1.000 | 0.100 | 0.100 | --- | 0.050 | --- | --- | 85.750 | 12.000 |
| 2190-S-13 | 1.000 | 1.000 | 0.100 | 0.100 | --- | --- | 0.050 | --- | 85.750 | 12.000 |
| 2190-S-14 | 1.000 | 1.000 | 0.100 | 0.100 | --- | --- | --- | 0.005 | 85.795 | 12.000 |
| 2190-S-15 | 1.000 | 1.000 | 0.100 | 0.100 | --- | --- | --- | 0.010 | 85.790 | 12.000 |
| 2190-S (NS) | 1.000 | 1.000 | 0.100 | 0.050 | --- | 0.030 | --- | --- | 85.820 | 12.000 |

Table 1

(51) Int. Cl.

| | |
|---|---|
| ***C10M 129/76*** | (2006.01) |
| ***C10M 133/12*** | (2006.01) |
| ***C10M 133/42*** | (2006.01) |
| ***C10M 137/04*** | (2006.01) |
| ***C10M 141/10*** | (2006.01) |
| ***C10M 161/00*** | (2006.01) |
| ***C10M 169/04*** | (2006.01) |
| *C10N 30/00* | (2006.01) |
| *C10N 30/02* | (2006.01) |
| *C10N 30/06* | (2006.01) |
| *C10N 30/10* | (2006.01) |
| *C10N 30/12* | (2006.01) |
| *C10N 30/14* | (2006.01) |
| *C10N 30/18* | (2006.01) |
| *C10N 30/20* | (2006.01) |

(52) U.S. Cl.
CPC ..... *C10N 2030/02* (2013.01); *C10N 2030/06* (2013.01); *C10N 2030/10* (2013.01); *C10N 2030/12* (2013.01); *C10N 2030/14* (2013.01); *C10N 2030/18* (2013.01); *C10N 2030/20* (2013.01); *C10N 2030/40* (2020.05)

(56) References Cited

U.S. PATENT DOCUMENTS

| | | | | |
|---|---|---|---|---|
| 7,565,830 | B2 * | 7/2009 | Quest | G01M 3/20 508/591 |
| 9,321,980 | B2 | 4/2016 | Ricks | |
| 2003/0158050 | A1 | 8/2003 | Kawasaki et al. | |
| 2004/0224860 | A1 * | 11/2004 | Baba | C10M 171/02 208/19 |
| 2006/0128574 | A1 | 6/2006 | Dong et al. | |
| 2007/0004603 | A1 | 1/2007 | Iyer et al. | |
| 2007/0298990 | A1 | 12/2007 | Carey et al. | |
| 2009/0011961 | A1 | 1/2009 | Dong et al. | |
| 2010/0081590 | A1 * | 4/2010 | Rosenbaum | G01N 33/26 208/18 |
| 2011/0237478 | A1 | 9/2011 | Costello | |
| 2012/0088704 | A1 | 4/2012 | Ricks | |
| 2012/0101015 | A1 | 4/2012 | Frapin | |
| 2012/0316092 | A1 | 12/2012 | Fujita et al. | |
| 2015/0005208 | A1 | 1/2015 | Yaguchi et al. | |
| 2016/0237368 | A1 | 8/2016 | Hobday | |
| 2016/0237376 | A1 | 8/2016 | Ricks | |
| 2017/0137738 | A1 | 5/2017 | Hobson et al. | |
| 2017/0267942 | A1 | 9/2017 | Ricks | |
| 2018/0327689 | A1 | 11/2018 | Shinoda | |
| 2018/0371352 | A1 | 12/2018 | Gullapalli | |
| 2019/0031974 | A1 | 1/2019 | Ricks | |
| 2019/0136147 | A1 | 5/2019 | Holt et al. | |
| 2019/0300815 | A1 | 10/2019 | Losch et al. | |
| 2019/0322959 | A1 * | 10/2019 | Knobloch | C10M 101/00 |
| 2020/0017793 | A1 | 1/2020 | Dickerson | |
| 2020/0017794 | A1 | 1/2020 | Knobloch | |
| 2021/0024850 | A1 | 1/2021 | Parera | |
| 2022/0010228 | A1 * | 1/2022 | Collett | C10M 145/14 |

OTHER PUBLICATIONS

International Search Report and Written Opinion issued in PCT/US2021/040516, mailing date Mar. 25, 2022.
Office Action issued in U.S. Appl. No. 17/367,964, mailing date Nov. 1, 2021.
Extended European Search Report issued in EP21867304.4 on Jul. 23, 2024.

* cited by examiner

| Formulation | Durad | APAN | Irgamet 39 | Lubrizol 859 | Xiameter 200 | FB 152 | BYK 172 | Lubrizol 889D | Spectrasyn 10 | Spectrasyn 40 |
|---|---|---|---|---|---|---|---|---|---|---|
| METSS 2190-S | 1.000 | 1.000 | 0.100 | 0.100 | 0.002 | --- | --- | --- | 85.798 | 12.000 |
| 2190-S-8 | 1.000 | 1.000 | 0.100 | 0.100 | --- | 0.010 | --- | --- | 85.790 | 12.000 |
| 2190-S-9 | 1.000 | 1.000 | 0.100 | 0.100 | --- | 0.020 | --- | --- | 85.780 | 12.000 |
| 2190-S-10 | 1.000 | 1.000 | 0.100 | 0.100 | --- | 0.030 | --- | --- | 85.770 | 12.000 |
| 2190-S-11 | 1.000 | 1.000 | 0.100 | 0.100 | --- | 0.040 | --- | --- | 85.760 | 12.000 |
| 2190-S-12 | 1.000 | 1.000 | 0.100 | 0.100 | --- | 0.050 | --- | --- | 85.750 | 12.000 |
| 2190-S-13 | 1.000 | 1.000 | 0.100 | 0.100 | --- | --- | 0.050 | --- | 85.750 | 12.000 |
| 2190-S-14 | 1.000 | 1.000 | 0.100 | 0.100 | --- | --- | --- | 0.005 | 85.795 | 12.000 |
| 2190-S-15 | 1.000 | 1.000 | 0.100 | 0.100 | --- | --- | --- | 0.010 | 85.790 | 12.000 |
| 2190-S (NS) | 1.000 | 1.000 | 0.100 | 0.050 | --- | 0.030 | --- | --- | 85.820 | 12.000 |

Table 1

FIG. 1

| Formulation | Foaming (ASTM D892) | | |
|---|---|---|---|
| | Sequence I | Sequence II | Sequence III |
| Requirement (MIL-DTL-32353A) | <65 mL initial/0 mL final | <65 mL initial/0 mL final | <65 mL initial/0 mL final |
| METSS 2190-S | Trace/0 | 10/0 | Trace/0 |
| 2190-S-8 | 10/0 | NT | NT |
| 2190-S-9 | 28/0 | NT | NT |
| 2190-S-10 | Trace/0 | 15/0 | Trace/0 |
| 2190-S-11 | 0/0 | NT | NT |
| 2190-S-12 | 0/0 | NT | NT |
| 2190-S-13 | 20/0 | 340/0 | Trace/0 |
| 2190-S-14 | 12/0 | NT | NT |
| 2190-S-15 | 10/0 | NT | NT |
| 2190-S (NS) | 10/0 | 20/0 | Trace/0 |
| 2190-S-17 | 10/0 | 20/0 | Trace/0 |

Table 2

FIG. 2

| Formulation | Air Release (ASTM D3427) | RBOT (ASTM D2272) | TAN (ASTM D974) | Emulsion (ASTM D1401) |
|---|---|---|---|---|
| Requirement (MIL-DTL-32353A) | <15 min | > 2,000 min | < 0.50 mg KOH | 41/-/3 oil/water/emulsion |
| METSS 2190-S | 8.1 min | 2,800 | 0.38 | 41/39/0 |
| 2190-S-10 | 4.4 min | 2,958/3,530 | 0.36 | 41/39/0 |
| 2190-S (NS) | 4.6 min | 3,080 (inductive) | 0.29 | 41/39/0 |
| 2190-S-17 | NT | 3,505/3,619 | 0.35 | 41/39/0 |

Table 3

FIG. 3

| Characteristic | ASTM No. | MIL-DTL-32353A Requirement | METSS 2190-S | 2190-S (NS) |
|---|---|---|---|---|
| DTBP, ppm max. | MIL-DTL-32353A 4.4.2 | 10 | <0.5 | <7 |
| Chlorine, ppm max. | D6443 | 50 | 44 | <1 |
| Zinc, ppm max. | D4927, D6443, D4951 | 10 | <8 | <1 |
| Acid number, mg KOH/g oil max. | D974, D664 | 0.50 | 0.40 | 0.29 |
| Corrosion (in presence of synthetic seawater) | D665 | No Corrosion | No Corrosion | No Corrosion |
| Copper strip corrosion @ 100 °C, max. | D130 | 1 max | 1b | 1b shiny |
| Oil compatibility | See 4.4.4 | Pass all | NA | Pass all |
| Appearance | See 4.4.6 | Pass | Pass | Pass |
| Water, % (ppm) max. | D6304 | 0.01 (100) | 0.005 (50) | 0.004 (40) |
| Density, g/mL | D287, D1298, D4052 | 0.82-0.86 | 0.84 | 0.84 |
| Air release time, minutes at 50 °C max. | D3427 | 15 | 8.1 | 4.6 |
| Flash point, open cup, °C (°F) min. | D92 | 266 (510) | 284 (543) | 284 (543) |
| Flash point, closed cup, °C (°F) min. | D93 | 232 (450) | 280 (536) | 240 (464) |
| Pour point, °C (°F) max. | D97, D5950, D5949 | -40 | -51 | -48 |
| Viscosity, cSt. | | | | |
| Centistokes at 4.4 °C (40 °F), max. | D445 | 800 | 650 | 628 |
| Centistokes at 40 °C (104 °F) | | 77-97 | 84 | 84 |
| Centistokes at 100 °C (212 °F), min. | | 11 | 12 | 12 |

Table 4

FIG. 4A

| | | | | |
|---|---|---|---|---|
| Viscosity index, min. | D2270 | 130 | 137 | 137 |
| Emulsion test, after 30-min settling time<br>Oil layer/water layer/emulsion, max. | D1401 | 41/report/3 | 40/40/0 | 41/39/0 |
| Oxidation test, after 1000 hours<br>Total sludge, mg max.<br>Total iron, mg max.<br>Total copper, mg max.<br>Acid number, mg KOH/g max. | D4310<br><br><br><br>D974, D664 | <br>50<br>10<br>10<br>1.2 | <br>10.2<br>0.0<br>0.1<br>1.06 | <br>16<br>5.6<br>0.3<br>0.24 |
| Oxidation by rotating pressure vessel, minutes, min. | D2272 | 2000 | 3000 | 3080 |
| Scuffing load capacity (FZG), failure load stage | D5182 | Load stage 9 | Load stage 9 | Load stage 11 |
| Four ball wear test, scar diameter, mm max. | D4172 | 0.75 | 0.48 | 0.41 |
| Homogeneity, separation | MIL-DTL-32353A 4.4.5 | None | None | None |
| Solid particle contamination, mg/100 mL max. | D4898 | 2.5 | 0.20 | 0.22 |
| Foaming characteristics<br>After blowing/after 10 minutes<br>Sequence 1, mL max.<br>Sequence 2, mL max.<br>Sequence 3, mL max. | D892 | <br><br>65/0<br>65/0<br>65/0 | <br><br>0/0<br>0/0<br>0/0 | <br><br>Trace/0<br>Trace/0<br>Trace/0 |
| Corrosion-oxidation stability (72 hours @ 175 °C) | D4636 | | | |

Table 4, Cont.

FIG. 4B

| Characteristic | ASTM No. | MIL-DTL-32353A Requirement | METSS 2190-S | 2190-S (NS) |
|---|---|---|---|---|
| Change in viscosity @ 40 °C, % max. | | 10.0 | 6.19 | +5.14 |
| Change in total acid number, mg KOH/g max. | | 0.30 | -0.13 | 0.08 |
| Evaporation loss, % max. | | 1.0 | 0.63 | 0.54 |
| Sludge determination, mg max. | | 25.0 | 18.4 | 13.9 |
| Metal coupon weight change, $mg/cm^2$ | | | | |
| Copper | | ±0.4 | 0.0 | -0.008 |
| Aluminum | | ±0.2 | +0.01 | +0.016 |
| Steel | | ±0.2 | +0.01 | +0.008 |
| Magnesium | | ±0.2 | +0.01 | +0.008 |
| Cadmium | | ±0.2 | +0.02 | +0.016 |
| Hydrolytic stability | | | | |
| Cu strip weight change, $mg/cm^2$ max. | | 0.2 | -0.03 | 0 |
| Cu strip appearance, max. | | 1 | 1 | 1b (shiny) |
| Fluid viscosity change, % max. | D2619 | 5 | 0.11 | -0.20 |
| Fluid TAN change, mg KOH/g max. | | 0.3 | -0.09 | -0.09 |
| Water TAN change, mg KOH/g max. | | 10 | 6.61 | 5.39 |
| Insolubles, wt. % max. | | 0.1 | 0.033 | 0.006 |

Table 4, Cont.

FIG. 4C

| | | | | |
|---|---|---|---|---|
| Elastomer compatibility | | | | |
| NBR-L (168 hours @ 70 °C) | FTM 3604 | | | |
| Hardness change, max. | | 10 | -2 | -3 |
| Volume change (swell), % max. | | -2 to +15 | +5.6 | +2.77 |
| Tensile change, % max. | | 30 | +3.1 | +1.85 |
| Elongation, % max. | | 30 | -11 | -7.41 |
| FKM (72 hours @ 175 °C) | FTM 3432 | | | |
| Hardness change | | 10 | -2 | +1 |
| Volume change (swell), % max. | | -2 to +15 | +0.8 | +0.97 |
| Tensile change, % max. | | 30 | +3.1 | +7.32 |
| Elongation, % max. | | 30 | -8.9 | -20 |
| AWC polyurethane (72 hours @ 70 °C) | D471, D412 | | | |
| Hardness change | | 10 | 0 | +1 |
| Volume change (swell), % max. | | -2 to +15 | +2.1 | +2.17 |
| Tensile change, % max. | | 30 | +4.3 | +5.06 |
| Elongation, % max. | | 30 | +5.4 | +2.78 |

Table 4, Cont.

FIG. 4D

| Formulation | APAN | Igramet 39 | LUBRIZOL® 859 | PAO-6 |
|---|---|---|---|---|
| 2075-S-22 | 1.0% | 0.05% | 0.05% | 98.90% |

Table 5

FIG. 5

| 2075-S-22 (plus) | | Foam Volume (mL) after 5 min / 10 min | |
|---|---|---|---|
| Percent Surfactant | Percent FoamBan 152 | Alone | Blended 1:1 with 2075-T-H |
| --- | --- | 0/0 | 190/0 |
| --- | 0.120 | 0/0 | 100/0 |
| 0.010 | --- | 0/0 | 175/0 |
| 0.025 | --- | 0/0 | 100/0 |
| 0.050 | --- | 10/0 | 80/0 |
| 0.050 | 0.050 | 0/0 | 60/0 |
| 0.050 | 0.075 | 0/0 | 40/0 |
| 0.050 | 0.100 | 0/0 | 40/0 |

Table 6

FIG. 6

| Formulation | Durad 310 (wt%) | Naugalube APAN (wt%) | Irgamet 39 (wt%) | Lubrizol 859 (wt%) | FB 152 (wt%) | Basestock 1 (wt%) | Basestock 2 (wt%) |
|---|---|---|---|---|---|---|---|
| METSS 2190-TEP | 1.000 | 0.250 | 0.100 | 0.050 | 0.030 | EHC 45 8.014 | EHC 120 90.556 |
| 2190-TEP-2 | 1.000 | 0.250 | 0.100 | 0.050 | 0.030 | 100R 10.813 | 600R 87.757 |

Table 7

FIG. 7

| Characteristic | ASTM Test Method | MIL-PRF-17331L Requirement | METSS 2190-TEP MIL-PRF-17331L |
|---|---|---|---|
| Sulfur, percent | D4927 (R), D129, D1552, D2622, D495, D6443, D6481, D7751 | Report | 0.0002<br>2 ppm (by X-ray) |
| Acid Number, mg KOH/g, max | D974, D664 | 0.30 | 0.25 |
| Corrosion (in presence of salt water) | D665 | None | None |
| Corrosion test at 100 °C (212 °F), (copper strip) apparence, max. | D130 | Classification 1 | 1b |
| Oil compatibility | D7155, Option 2 | Pass | Pass |
| Water, percent by mass, max | D6304 | 0.01 | .002 |
| Gravity, American Petroleum Institute (API) / Density (g/mL) | D287, D1298, D4052 | Report | 32.1 / 0.8649 |
| Air release time, minutes at 50 °C max | D3427 | 20 | 13.2 |
| Flash Point, closed cup, °C (°F) min | D93 | 204 (400) | 232 (450) |
| Flash point, open cup, °C (°F) min | D92 | 234 (453) | 272 (523) |
| Pour Point, °C (°F) max | D97, D5950 | -6 (20) | -18 (-0.4) |
| Kinematic Viscosity at 4.4 °C, cSt max | D445 | 870 | 861.7 |
| Kinematic Viscosity at 40 °C, cSt | | 77-97 | 87.21 |
| Kinematic Viscosity at 100 °C, cSt min | | 8.0 | 10.73 |
| Emulsion test, after 30 minutes settling time, oil layer/water layer/emulsion, max. | D1401 | 41/-/3 | 41/39/0 |

Table 8

FIG. 8A

| | | | |
|---|---|---|---|
| Oxidation test, after 1500 hours @ 95 °C: | D4310 | | |
| Acid number, mg KOH/g, max | D664 | 2.0 | 0.26 |
| Total sludge, mg, max. | D4310 | 100 | 13.0 |
| Total iron, mg, max. | D4310 | 100 | 0.2 |
| Total copper, mg, max | D4310 | 100 | 0. 4 |
| Oxidation by rotating pressure vessel, minutes to failure, min. | D2272 | 300 | 958 |
| Scuffing load capacity (FZG), failure load stage | D5182 | Load Stage 9 | Load Stage 12 |
| Wear test, scar diameter, mm, max. | D4172 | 0.33 | 0.25 |
| Homogeneity, separation | Sec 4.4.1 | None | Conforms |
| Foam characteristics: | | | |
| After blowing/after 10 minutes | D892 | | |
| Sequence I, mL, max. | | 65/0 | Trace/0 |
| Sequence II, mL, max | | 65/0 | 50/0 |
| Sequence III, mL, max. | | 65/0 | Trace/0 |
| Solid particle contamination, mg/100 mL, max | D4898 | 2.5 | 0.36 |
| Thermal stability: | | | |
| Copper appearance, visual max. | D2070 | Report | Shiny #5 |
| Steel appearance, visual max. | | Report | Shing #2 |
| Sludge, mg/100 mL, max. | | 25 | 6.1 |
| Coking tendency | FTM-3462 | Panel coker test | Coking wt. = 16.2 mg<br>Oil: Reddish Brown<br>Consumption: 40 mL |

Table 8, Cont.

FIG. 8B

LUBRICATING COMPOSITIONS COMPRISING A NON-SILICONE ANTI-FOAMING AGENT

GOVERNMENT SUPPORT

This invention was made with government support under contract no. N00178-17-C-2008 awarded by the United States Navy. The government may have certain rights in the invention.

CROSS-REFERENCE TO RELATED APPLICATIONS

This application claims priority from U.S. Provisional Patent Application No. 63/049,463, filed on Jul. 8, 2020, which is incorporated by reference herein in its entirety.

BACKGROUND

Lubricating compositions used in nuclear-powered propulsion systems for ships and submarines may encounter challenging operating conditions in terms of temperature, pressure, wear, service life, and the like. Operating systems need to perform reliably over long time periods and extended deployments. If problems occur at sea, little opportunity exists for outside assistance. It is therefore desirable that a lubricating composition for use aboard surface ships, submarines, and non-watercraft structures where similar problems are posed sustain its reliability and functionality, maximize performance, and limit surplus stowage (due to weight and space constraints).

For more than a half century, the lubricating composition used aboard U.S. Navy ships and submarines has been a mineral-oil based gear oil known as 2190-TEP that meets the military specification MIL-PRF-17331. 2190-TEP is a non-synthetic lubricating oil intended for use in main and auxiliary turbines and gears, air compressors, and certain hydraulic equipment, as well as for general mechanical lubrication. 2075-T-H is another military-specified, inhibited petroleum-based hydraulic fluid containing anti-corrosion and anti-oxidation additives for use in hydraulic systems and in other applications aboard submarines where a high-grade lubricating oil having anti-corrosion and anti-oxidation properties is required. The military specification, MIL-PRF-1762E, governs 2075-T-H. 2110-T-H and 2135-T-H are also specified under MIL-PRF-1762E and are further examples of inhibited petroleum-based, external hydraulic fluids analogous to 2075-T-H but are used aboard naval surface ships.

All three of 2075-T-H, 2110-T-H, and 2135-T-H meet the requirements of MIL-PRF-17672E. However, today's advanced hydraulic and propulsion systems for ships and submarines are expected to maintain exceptional reliability and operate under harsh conditions to avoid out-of-commissions, or "OOCs." The net result of these challenging operational tempos is that existing mineral-based fluids are failing more quickly, leading to high oil replacement and increased disposal costs.

Problems observed in conjunction with the use of, for example, 2190-TEP, under stressful operating conditions include: (a) high depletion of antioxidants; (b) sharp increases in total acid number ("TAN"); (c) severe off-gassing events; (d) elevated insoluble contaminants; (e) excessive moisture content; (f) sub-optimal viscosity index; (g) increased flash point; (h) unpredictable coloration; (i) sticky and sluggish hydraulic control valve operation; and (j) excessive carbon build-up in high pressure air compressors ("HPAC"s). Degradation may lead to the formation of harmful byproducts such as formaldehyde and carbon monoxide, which can be particularly hazardous in the close operating conditions of submarines and many surface ships.

Improved formulations to supplement or replace 2190-TEP and 2075-T-H exist. However, at least some of these improved formulations comprise a silicone-based anti-foaming agent. Silicone-based anti-foaming agents may be difficult to blend with other components of the lubricating composition and may, under some operating conditions, precipitate. Still other limitations may include unacceptable foaming and other incompatibilities upon contacting certain of these improved formulations with, e.g., existing 2190-TEP and 2075-T-H fluids.

A need exists for alternative lubricating compositions and additive compositions that are readily able to be blended, can operate under extreme conditions, and can be contacted or mixed with at least residual (such as what may remain from prior use aboard a ship, submarine, or other structure) existing fluids (e.g., 2190-TEP and 2075-T-H) without resulting in out-of-specification characteristics, such as, for example, foaming.

BRIEF DESCRIPTION OF THE FIGURES

The present invention may be more readily understood by reference to the following figures, wherein:

FIG. 1 provides a table (Table 1) showing lubricating compositions comprising non-silicone anti-foaming agents.

FIG. 2 provides a table (Table 2) showing results of the evaluation of the lubricating compositions shown in FIG. 1/Table 1 against the MIL-DTL-32353A specification regarding foaming characteristics (ASTM D892).

FIG. 3 provides a table (Table 3) showing results of the evaluation of selected lubricating compositions shown in FIG. 1/Table 1 against the MIL-DTL-32353A specifications for Air Release (ASTM D3427), the Rotating Bomb Oxidation Test (RBOT) (ASTM D2272), TAN (ASTM D974), and emulsion requirements (ASTM D1401). In some circumstances, the lubricating compositions were compared to a commercially available silicone-containing formulation.

FIGS. 4A-4D provide a table (Table 4) showing results of the evaluation of 2190-S (NS) against various MIL-DTL-32353A specifications and compared to a commercially available silicone-containing formulation.

FIG. 5 provides a table (Table 5) showing an example synthetic lubricating composition.

FIG. 6 provides a table (Table 6) showing the effect of addition of surfactant and anti-foaming agent to reduce foaming upon contacting the synthetic lubricating composition shown in FIG. 5/Table 5 with mineral-oil-based fluids.

FIG. 7 provides a table (Table 7) showing mineral oil-based lubricating compositions comprising non-silicone anti-foaming agents.

FIGS. 8A-8B provide a table (Table 8) showing results of the evaluation of a selected lubricating composition among those shown in FIG. 7/Table 7 against various requirements of the MIL-DTL-17331L specification.

SUMMARY

In one aspect, lubricating compositions are provided, the lubricating compositions comprising a base oil component and an additive component, wherein the additive component comprises a non-silicone anti-foaming agent.

In some aspects, the lubricating compositions comprise, for example:

a polyalphaolefin base oil component, a mineral oil base oil component, or both; and an additive component comprising a non-silicone anti-foaming agent and one or more of:

an anti-wear agent;

an aryl amine antioxidant agent;

a metal deactivating agent; and an anti-rust agent.

In another aspect, an additive component is provided, the additive component comprising a non-silicone anti-foaming agent and one or more of:

an anti-wear agent;

an aryl amine antioxidant agent;

a metal deactivating agent; and an anti-rust agent.

In yet another aspect, a method for lubricating an apparatus is provided, the method comprising, for example, contacting one or more components of the apparatus with a lubricating composition, the lubricating composition comprising:

a polyalphaolefin base oil component, a mineral oil base oil component, or both; and an additive component comprising a non-silicone anti-foaming agent and one or more of:

an anti-wear agent;

an aryl amine antioxidant agent;

a metal deactivating agent; and an anti-rust agent.

DETAILED DESCRIPTION

Lubricating compositions comprising additive components are provided. The lubricating compositions comprise, for example, a polyalphaolefin base oil component, a mineral oil base oil component, or both, comprising from about 90% to about 99.5% w/w of the lubricating composition. The additive components comprise a non-silicone anti-foaming agent and may further comprise, for example, an anti-wear agent; an aryl amine antioxidant agent; a metal deactivating agent; and an anti-rust agent, and comprise, in the aggregate, from about 0.5% to about 10% w/w of the lubricating composition. The lubricating compositions comprising the additive components may be used to lubricate an apparatus, such as an apparatus that is operated under extreme operating conditions. The lubricating compositions comprising the additive components may also be used to provide hydraulic (transmission of force) controls, such as for ship and submarine maneuvering.

Definitions

Unless otherwise defined, all technical and scientific terms used herein have the same meaning as commonly understood by one of ordinary skill in the art to which this invention pertains. In case of conflict, the present specification, including definitions, is intended to control.

Unless otherwise specified, "a," "an," "the," "one or more of," and "at least one" are used interchangeably. The singular forms "a", "an," and "the" are inclusive of their plural forms.

The recitations of numerical ranges by endpoints include all numbers subsumed within that range (e.g., 1 to 5 includes 1, 1.5, 2, 2.75, 3, 3.80, 4, 5, etc.).

The term "about," when referring to a value or to an amount of mass, weight, time, volume, concentration, or percentage is merely shorthand and is meant to encompass variations of ±10% from the specified amount. Thus, for example, "about 10" means 9 to 11; "between about 10 and about 20" includes 9 to 22 and 11 to 18. The recitation of a number without preceding it with the term "about" means exactly that number. Thus, for example, "10" means 10.

The terms "comprising" and "including" are intended to be equivalent and open-ended.

The phrase "consisting essentially of" means that the composition or method may include additional ingredients and/or steps, but only if the additional ingredients and/or steps do not materially alter the basic and novel characteristics of the claimed composition or method.

The conjunctive phrase "and/or" indicates that either or both of the items referred to can be present.

The term "organic group" means a hydrocarbon group that is classified as an aliphatic group, cyclic group, or combination of aliphatic and cyclic groups (e.g., alkaryl and aralkyl groups). The term "aliphatic group" means a saturated or unsaturated linear or branched hydrocarbon group, including alkyl, alkenyl, and alkynyl groups, for example.

The terms "alkyl," "alkenyl," and the prefix "alk-" are inclusive of straight chain groups and branched chain groups and cyclic groups, e.g., cycloalkyl and cycloalkenyl groups. Unless otherwise specified, these groups contain from one to 20 carbon atoms, with alkenyl groups containing from two to 20 carbon atoms. In some aspects, these groups have 10 or fewer carbon atoms, eight or fewer carbon atoms, six or fewer carbon atoms, or four or fewer carbon atoms. Lower alkyl groups are those including six or fewer carbon atoms. Examples of alkyl groups include haloalkyl groups and hydroxyalkyl groups.

Unless otherwise specified, "alkylene" and "alkenylene" are the divalent forms of the "alkyl" and "alkenyl" groups defined above. The terms "alkylenyl" and "alkenylenyl" are used when "alkylene" and "alkenylene," respectively, are substituted. For example, an arylalkylenyl group comprises an alkylene moiety to which an aryl group is attached.

The term "aryl" includes carbocyclic aromatic rings or ring systems. Examples of aryl groups include phenyl, naphthyl, biphenyl, anthracenyl, phenanthracenyl, fluorenyl, and indenyl. Aryl groups may be substituted or unsubstituted.

The terms "coefficient of friction," "friction," and "mechanical friction," being either static or kinetic, generally refer to a measure of the sliding resistance of a material over another material. In certain aspects, the source of friction may be from sliding, rolling, starting, stopping, shock loading, and the like, or combinations thereof. The terms "improved anti-wear," "reducing wear," "reducing a rate of wear," "wear rate reduction," "improving wear protection," "increasing anti-wear properties," and "increased wear resistance" may be used interchangeably.

The term "silicone-based anti-foaming agent" refers to polymers with silicon backbones, which may be delivered as an oil or a water-based emulsion. The silicone compound may comprise a hydrophobic silica dispersed in a silicone oil. Emulsifiers may be added to ensure that the silicone spreads fast and well in the foaming medium. The silicone compound might also contain silicone glycols and other modified silicone fluids. Xiameter PMX-200 Silicone Fluid, 12500CS is an example of a silicone-based anti-foaming agent. It should be noted that although the lubricating compositions described and claimed herein comprise a non-silicone anti-foaming agent, and in certain aspects, only a non-silicone anti-foaming agent (that is, silicone-based anti-foaming agents are excluded), lubricating compositions are also envisioned that comprise a non-silicone anti-foaming agent and a silicone-based anti-foaming agent.

The more rigorous performance conditions demanded by many newer seafaring vessels can be addressed through use of the lubricating compositions described and claimed herein. In addition to submarines, newer surface ships with controllable pitch propeller systems have placed additional demands on lubricating compositions. The improved properties of the lubricating compositions described herein may also be useful to complement or replace existing hydraulic fluids, air compressor fluids, and main reduction gear fluids.

Base Oil Component

The base oil component of the lubricating compositions typically provides most of the lubricating composition by weight. The base oil component may be about 90, 91, 92, 93, 94, 95, 95.5, 96, 96.5, 97, 97.5, 98, 98.5, 99, or 99.5% w/w of the lubricating composition or a range between any two of the preceding values, for example, from about 95% to about 99.5% w/w of the lubricating composition.

Base oil components of lubricating viscosity may further be defined as specified in the American Petroleum Institute ("API") Base Oil Interchangeability Guidelines. The five base oil component groups are as follows: Group I viscosity index 80-120; Group II/II+ (viscosity index 80-120); Group III viscosity index ≥120); Group IV (all polyalphaolefins, or "PAO"s); and Group V (which encompasses "all others"). Mixtures of PAOs and mineral oils are referred to as semi-synthetic oils.

In some aspects, the base oil component comprises one or more API Group IV base oils. In some aspects, the base oil component comprises one or more PAOs. Suitable PAOs include, for example, PAO-2, PAO-4, PAO-5, PAO-6, PAO-7, PAO-8, PAO-10, PAO-40, PAO-100, or any combination thereof. In some aspects, the base oil component includes PAO-6, PAO-10, PAO-40, PAO-100, or any combination thereof.

In some aspects, the base oil component is one or more PAOs. Polyolefins are a type of polymer produced from an alkene with the general formula $C_nH_{2n}$ as a monomer. Most commercially useful polyolefins are PAOs, which are made by polymerizing an alpha-olefin. Alpha-olefins are alkenes in which the carbon-carbon double bond starts at the α-carbon atom, i.e., the double bond is between carbons C1 and C2 of the molecule. PAOs typically do not crystallize or solidify easily and are able to remain as oily, viscous liquids even at lower temperatures. Alpha-olefins such as 1-hexene may be used as co-monomers to give an alkyl branched polymer, although 1-decene is most used for lubricating base stocks.

A PAO base oil component included in a lubricating composition can be obtained by polymerizing at least one monomer, e.g., a 1-olefin, in the presence of hydrogen and a catalyst composition. Alpha-olefins suitable for use in the preparation of the PAOs can contain, for example, from two to 30, two to 20, or six to 12 carbon atoms. Non-limiting examples of such alpha-olefins include ethylene, propylene, 2-methylpropene, 1-butene, 3-methyl-1-butene, 1-pentene, 4-methyl-1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, and 1-eicosene, and mixtures thereof. In some aspects, suitable alpha-olefins include 1-octene, 1-decene, and 1-dodecene, and mixtures thereof.

In some aspects, if the number of carbon atoms in a single alpha-olefin structure is less than six, viscosity properties may decrease. In some aspects, if the number of carbon atoms exceeds 20, desirable viscosity properties may be obtained, but the interaction between side chains with respect to shear stress from the outside may increase relative thereto, which may cause molecular cleavage, lowering shear stability. Accordingly, in some aspects, use of PAOs including an alpha-olefin having from six to 20 carbons is suitable. Furthermore, in some aspects, the use of the mixture of different PAOs may facilitate the preparation of a PAO in which both viscosity properties and low-temperature properties are surprisingly good.

Examples of commercially available base stock synthetic PAOs are typically sold according to nominal kinematic viscosity at 100° C. in centiStokes, e.g., SpectraSyn 10 (ExxonMobil) has a kinematic viscosity at 100° C. of 10 centiStokes; SpectraSyn 40 (ExxonMobil) has a kinematic viscosity at 100° C. of 40 centiStokes; and the like. In some aspects, the PAOs can be selected from one or more of PAO-2, PAO-7, PAO-8, PAO-9, PAO-10, PAO-40, PAO-65M, and PAO-65E. These PAOs are characterized by having a kinematic viscosity at 100° C. of the number included in their title. For example, PAO-2 is a PAO having a kinematic viscosity at 100° C. of 2 centiStokes.

The PAO may include any PAO or PAO blend with sufficient kinematic viscosity. For example, the kinematic viscosity of the composition at 100° C. in centiStokes may be about, or at least about, one or more of: 2, 4, 6, 7, 8, 10, 10.25, 10.5, 10.75, 11, 11.25, 11.5, 11.75, 12, 12.25, 12.5, 12.75, 13, 13.5, 14, 14.5, 15, 17.5, 20, 25, 30, 35, 40, 45, 50, 75, or 100, or a range between any two of the preceding values, for example, between about 10 and about 100. In various aspects, the kinematic viscosity of the lubricating composition may be determined at least in part by the PAO. The desired kinematic viscosity of the lubricating composition may be approximately selected by mixing various amounts of commercially available PAO fractions.

In some aspects, the PAO comprises from about 80% to about 90% of a first PAO having a kinematic viscosity of about 10 centiStokes at 100° C. (e.g., SPECTRASYN™ 10), and from about 10% to about 20% of a second PAO having a kinematic viscosity of about 40 centiStokes at 100° C. (e.g., SPECTRASYN™ 40). In some aspects, the lubricating composition may be characterized by a kinematic viscosity at 100° C. of at least about 5 centiStokes and a viscosity index of at least about 80. In some aspects, the lubricating composition may be characterized by a kinematic viscosity at 100° C. of about 5 to about 8 centiStokes, a kinematic viscosity at 40° C. of about 29 to about 33 centiStokes, and a viscosity index of about 110 to about 210. In some aspects, the lubricating composition is characterized by a kinematic viscosity at 100° C. of about 8 to about 10 centiStokes, a kinematic viscosity at 40° C. of about 43 to about 47 centiStokes, and a viscosity index of about 160 to about 220. In some additional aspects, the lubricating composition is characterized by a kinematic viscosity at 100° C. of about 11 to about 13 centiStokes, a kinematic viscosity at 40° C. of about 64 to about 70 centiStokes, and a viscosity index of about 150 to about 210.

In some aspects, the base oil component comprises a mineral oil. Examples of suitable mineral oils include liquid petroleum oils, paraffinic mineral oils, intermediate mineral oils, naphthenic mineral oils, distillate oils obtained by vacuum distillation of an atmospheric residual oil, and mineral oils and waxes (e.g., gas-to-liquid wax) obtained by subjecting a distillate oil to at least one refining process, such as solvent de-asphalting, solvent extraction, hydrofinishing, solvent dewaxing, catalytic dewaxing, isomerization dewaxing, and vacuum distillation.

Mineral oils are categorized as Group I, Group II/II+, and Group III base oil stocks. Useful Group I-III base stocks have a kinematic viscosity at 100° C. of greater than 2 centiStokes to 25 centiStokes. Group I base stocks are solvent refined, can be considered to have a viscosity index of between 80 to 120, contain greater than 0.03% sulfur, and contain less than 90% saturates. Group II base stocks are manufactured by hydrocracking, can be considered to have a viscosity index of between 80 to 120, contain less than or equal to 0.03% sulfur, and contain greater than or equal to 90% saturates. Group III base stocks are severely hydrocracked, can be considered to have a viscosity index greater than 120, contain less than or equal to 0.03% sulfur, and contain greater than 90% saturates.

In some aspects, the mineral oil comprises from about 85% to about 95% of a first mineral oil having a kinematic viscosity of about 11 to about 13 centiStokes at 100° C. (e.g., ExxonMobil EHC 120, Chevron Neutral Oil 600R), and from about 6% to about 11% of a second mineral oil having a kinematic viscosity of about 4 to about 5 centiStokes at 100° C. (e.g., ExxonMobil EHC 45, Chevron Neutral Oil 100R).

Additive Component

The lubricating compositions may also comprise an additive component. The additive component comprises a non-silicone anti-foaming agent and may further include one or more of an anti-wear agent; an aryl amine antioxidant agent; a metal deactivating agent; and an anti-rust agent. In some aspects, the lubricating composition consists essentially of a PAO base oil component and an additive component. In some aspects, the lubricating composition consists of a PAO base oil component and an additive component. Lubricating compositions may be characterized by a TAN in mg KOH/g of between about 0.1 and about 1.

The additive component may comprise from about 0.5% to about 10% of the lubricating composition. The additive component comprises a non-silicone anti-foaming agent, and the non-silicone anti-foaming agent comprises from about 0.01% to about 0.10% w/w of the lubricating composition, including from about 0.01% to about 0.05%, including about 0.3%. In some aspects, the additive component comprises an anti-wear agent, and the anti-wear agent comprises from about 0.05% to about 2% w/w of the lubricating composition, including from about 0.5% to about 2%, including about 1%, and including 0.05%. In some aspects, the additive component comprises an aryl amine antioxidant, and the aryl amine antioxidant comprises from about 0.5% to about 2% w/w of the lubricating composition. In some aspects, the additive component comprises a metal deactivating agent, and the metal deactivating agent comprises from about 0.05% to about 0.2% w/w of the lubricating composition. In some aspects, the additive component comprises an anti-rust agent, and the anti-rust agent comprises from about 0.01% to about 0.10% w/w of the lubricating composition. In some aspects, the lubricating composition comprises: from about 0.05% to about 2% w/w of an anti-wear agent; from about 0.5% to about 2% w/w of an aryl amine antioxidant agent; from about 0.05% to about 0.2% w/w of the metal deactivating agent; from about 0.01% to about 0.10% w/w of the anti-rust agent; and from about 0.010% to about 0.10% w/w of the non-silicone anti-foaming agent.

The additive component, when included in a lubricating composition, can be present in a percentage of one or more of about: 0.5, 1, 1.5, 2, 2.5, 3, 3.5, 4, 4.5, 5, 5.5, 6, 6.5, 7, 7.5 8, 8.5, 9, 9.5, and 10 w/w of the lubricating composition or a range between any two of the preceding values, for example, between about 0.5% and about 5% w/w of the lubricating composition.

The additive component comprises a non-silicone anti-foaming agent and may further comprise one or more of: an anti-wear agent; an aryl amine antioxidant agent; a metal deactivating agent; and an anti-rust agent. In some aspects, the additive component consists exclusively of these agents. In other aspects, the additive component comprises additional components, such as a pour point depressant, a demulsifier, a dispersant, or additional different anti-wear or other main agents. In further aspects, the additive component consists essentially of: a non-silicone anti-foaming agent; an anti-wear agent; an aryl amine antioxidant agent; a metal deactivating agent; and an anti-rust agent, but may include small amounts of other compounds, such as a dye, that do not materially affect the ability of the additive to provide a suitable lubricating composition. In some aspects, the dye comprises a Unisol red dye.

The additive component can include varying amounts of the additive agents. For example, the additive component may comprise from about 0.5% to about 2% w/w of a non-silicone anti-foaming agent. The additive component may comprise from about 40% to about 60% w/w of an anti-wear agent. The additive component may comprise from about 40% to about 60% w/w of an aryl amine antioxidant agent. The additive component may comprise from about 2% to about 6% w/w of a metal deactivating agent. The additive component may comprise from about 1% to about 3% w/w of an anti-rust agent.

With further respect to the non-silicone anti-foaming agent, in some aspects, suitable non-silicone anti-foaming agents include, for example, polyacrylate polymer anti-foaming agents, non-limiting examples of which include FOAM BAN® 152 and FOAM BAN® 3633E, both of which are non-silicone polyacrylate polymer anti-foaming agents available from MÜNZING MOBILE. Other suitable non-silicone anti-foaming agents may include, for example, BYK-1752, BYK-1790, and LUBRIZOL® 889D. The non-silicone anti-foaming agent may be present, in a w/w percentage of the lubricating composition, of about 0.01, 0.02, 0.03, 0.04, 0.05, 0.06, 0.07, 0.08, 0.09, or 0.10, or a range between any two of the two preceding values, for example, from about 0.01% to 0.1% w/w of the lubricating composition.

With further respect to the anti-wear agent, in some aspects, the anti-wear agent may include one or more of: an alkylated triarylphosphate, e.g., alkylated with one or more C3-C6 alkyl groups, such as isopropyl triaryl phosphate, tert-butyl triaryl phosphate, and the like; an alkyl phosphate, e.g., with a C4-C18 alkyl group, such as octyl phosphate, decyl phosphate, dodecyl phosphate, tetradecyl phosphate, hexadecyl phosphate, combinations thereof, and the like; a diarylether phosphate ester; a diarylether phosphate diester diphosphate; combinations thereof; and the like. For example, the anti-wear agent may include one or more of: a C3-C6 alkylated triarylphosphate, a C4-C18 alkyl phosphate, a diarylether phosphate ester, and a diarylether phosphate diester diphosphate.

In several aspects, esters in the anti-wear agent may be partly esterified, e.g., partly esterified dodecyl phosphate, such that the anti-wear agent may be characterized by a TAN, e.g., according to D974 (American Society for Testing Materials, West Conshohocken, PA). For example, the anti-wear agent may be characterized by TAN in mg KOH/g of one of about 1, 2.5, 5, 7.5, 10, 11, 12, 13, 14, 15, 17.5, 20, 22.5, 25, 27.5, 30, 35, 40, 45, 50, 75, 100, 125, 150, 175, or 200, or a range between any two of the preceding values, for example, of from about 1 to about 200. The amount of the anti-wear agent in the composition may be selected in view of the TAN of the anti-wear agent to provide a TAN of the lubricating composition. For example, the TAN of the lubricating composition in mg KOH/g may be about: 0.1, 0.2, 0.3, 0.4, 0.5, 0.6, 0.7, 0.8, 0.9, or 1, or a range between any two of the preceding values, for example, between about 0.1 mg KOH/g and about 1 mg KOH/g.

In various aspects, suitable anti-wear agents may be obtained or requested according to the above characteristics from commercial sources of anti-wear agents, for example, DURAD® 310M, a mixture of isopropyl triphenyl phosphate and partially esterified C8-C16 phosphates (reaction products of a mixture of C8-C16 alcohols with phosphorus oxide), having a nominal TAN of 13 mg KOH/g (CHEMPOINT®, Bellevue, WA); certain REOLUBE® series phosphate ester additives (Canoil Canada Ltd., Mississauga, Ontario CA); certain FRYQUEL® series phosphate ester additives (ICL Industrial Products, Gallipolis Ferry, WV); certain ADDITIN® series phosphate ester additives (Rhein Chemie Holland line, LANXESS Corporation, Pittsburgh, PA); certain LUBRIZOL® products (Lubrizol Corporation, Wickliffe, OH); and the like.

In various aspects, the anti-wear agent may be present, in a w/w percentage of the lubricating composition, of one of about 0.05, 0.075, 0.1, 0.2, 0.3, 0.4, 0.5, 0.55, 0.6, 0.65, 0.7, 0.75, 0.8, 0.85, 0.9, 0.95, 1, 1.05, 1.1, 1.15, 1.2, 1.25, 1.5, 1.75, 2, 2.25, or 2.5, or a range between any two of the preceding values, for example, of from about 0.05% to about 2% w/w of the lubricating composition.

With further respect to the aryl amine antioxidant agent, in some aspects, aryl amine antioxidants agents include phenyl alpha naphthyl amines ("PAN"s) and alkylated phenyl alpha naphthyl amines ("APAN"s), e.g., NAUGALUBE® series PAN/APAN antioxidants (CHEMPOINT®, Bellevue, WA). The aryl amine antioxidant agent may be present, in a w/w percentage of the lubricating composition, of one of about 0.1, 0.2, 0.3, 0.4, 0.5, 0.55, 0.6, 0.65, 0.7, 0.75, 0.8, 0.85, 0.9, 0.95, 1, 1.05, 1.1, 1.15, 1.2, 1.25, 1.5, 1.75, 2, 2.25, or 2.5, or a range between any two of the preceding values, for example, of from about 0.5% to about 2% w/w of the lubricating composition.

With further respect to the metal deactivating agent, in some aspects, suitable metal deactivating agents may include, for example, triazoles, e.g., tolyl triazole derivatives such as ADDITIN® RC 8239 (Rhein Chemie Holland line, LANXESS Corporation, Pittsburgh, PA) or Irgamet 39, which is available from BASF North America (Florham Park, NJ). The metal deactivating may be present, in a w/w percentage of the lubricating composition, of one of about 0.025, 0.05, 0.075, 0.100, 0.125, 0.150, 0.175, 0.2, 0.3, 0.4, or 0.5 or a range between any two of the preceding values, for example, of from about 0.05% to about 0.2% w/w of the lubricating composition.

With further respect to the anti-rust agent, in some aspects, suitable anti-rust agents include, for example, alkyl succinic acid esters, alkenyl succinic acid esters, and the like, e.g., derivatives such as ADDITIN® RC 4801 (Rhein Chemie Holland line, LANXESS Corporation, Pittsburgh) or LUBRIZOL® 859 (butanedioic acid, (tetrapropenyl)-, ester with 1,3-propanediol). In some aspects, the anti-rust agent and the anti-wear agent may be the same, and in some aspects, they may be different. The anti-rust agent may be present, in a w/w percentage of the lubricating composition, of one of about 0.01, 0.025, 0.05, 0.075, 0.100, 0.125, or 0.150, or a range between any two of the preceding values, for example, from about 0.010% to about 0.10%.

In various aspects, the anti-wear agent and the aryl amine antioxidant agent may be present in the composition in independently selected amounts. The anti-wear agent and the aryl amine antioxidant agent may be present in substantially equal amounts. For example, in some aspects, the anti-wear agent and the aryl amine antioxidant agent each comprise from about 40% to about 49% w/w of the additive component.

The anti-rust agent and the metal deactivating agent may be present in the composition in independently selected amounts. In some aspects, the anti-rust agent is present in an amount about half of that of the metal deactivating agent. In some aspects, the anti-rust agent and the anti-foaming agent may be present in substantially equal amounts. In further aspects, the amount of non-silicone anti-foaming agent is less than that of any of the other additive components.

Lubricated Apparatuses

In further aspects, an apparatus including a lubricating composition is provided. One or more components of the apparatus may be in contact with the lubricating composition. In accordance with certain aspects, when the lubricating composition is provided to at least one surface, the lubricating composition may reduce the coefficient of friction of the at least one surface. In accordance with other aspects, when the lubricating composition is provided to at least one surface, the lubricating composition may reduce wear of the at least one surface. In certain aspects, when the lubricating composition is provided to at least one surface, the lubricating composition may reduce the coefficient of friction and reduce wear of the at least one surface.

The lubricating compositions and additive components described herein may allow a single formulation to be produced, stored, and sourced for a variety of uses, which may be especially beneficial while at sea. Applications for the lubricating compositions and additive components include as lubricating oils, hydraulic oils, and other functional fluids for motion control, steam turbines, gears in ships and submarines, submarine air compressor lubricating oils, and in controllable pitch propeller systems in ships (e.g., Arleigh Burke-class destroyers). Of particular interest in many military applications are new lubricating compositions that provide corrosion resistance, hydraulic (fluid under pressure power transmission) properties, and lubricating properties.

The apparatus may be included in a vehicle or device that is operated under extreme operating conditions, such as a submarine, a ship, a wind turbine, or a windmill. In some aspects, the apparatus is a high-pressure air compressor or a nuclear power plant component. The components of the apparatus that are contacted with the lubricating composition may include, for example, one or more of: a hydraulic line, a hydraulic reservoir, a piston, a gear surface, a bearing surface, a cam surface, a compressor, a blade, a rotatable shaft, a variable-pitch propeller, a controllable-pitch propeller, and a turbine. Because the one or more components of the apparatus are contacted with the lubricating composition to decrease friction between the components, it is common for a plurality of components that interact with one another to be contacted with the lubricating composition.

A method for lubricating an apparatus is also provided. The method includes contacting one or more components of the apparatus with a lubricating composition. The components may be contacted with the lubricating composition by applying the lubricating composition to one or more surfaces of the components or by delivering the lubricating composition to a portion of the apparatus that is in fluid communication with the components.

The apparatus being lubricated may be one that is operated under extreme operating conditions. Because of the extreme operating conditions, the lubricating composition preferably exhibits long term stability. Examples of extreme operating conditions include high pressure, extreme temperatures (cold and/or hot), high mechanical loads, and risk of corrosion. In some aspects, the apparatus is lubricated while operating at a temperature from about −40° C. to about 240° C., while in other aspects, the apparatus is lubricated while operating at a temperature from about 4° C. to about 100° C. or from about 25° C. to about 60° C.

EXAMPLES

Examples have been included to describe more clearly how to make and use the lubricating compositions and the additive components. There are a wide variety of other aspects within the claimed scope, which should not be limited to these particular examples. The notation "NT" is shown where a given characteristic was not tested for a given formulation.

Example 1—Example Procedure for Preparation of a Lubricating Composition Comprising a Non-Silicone Anti-Foaming Agent ("2190-S(NS)")

To prepare 2190-S(NS) additive concentrate, the following compounds (with an associated approximate wt %±5 relative wt %) may be combined:

1. 45.250 wt % PAO 10 (SPECTRASYN™ 10 synthetic basestock)
2. 25.000 wt % DURAD® 310M (extreme pressure/anti-wear, phosphate ester blend (CAS Numbers 7057-92-3; 68937-41-7; 115-86-6))
3. 25.000 wt % NAUGALUBE® APAN (alkylated phenyl-alpha-naphthyl APAN amine, antioxidant (CAS Number 6465-05-3))
4. 1.250 wt % LUBRIZOL® 859 (antirust additive (alkenyl succinate ester))
5. 2.500 wt % Irgamet 39 (metal deactivator, tolytriazole derivative (CAS Number 80584-90-3))
6. 0.250 wt % Unisol Red BHF 0.237 (soluble red dye)
7. 0.750 wt % FOAM BAN® 152 (non-silicone anti-foaming agent)

2190-S(NS) mixing procedure (assume batch volume=550 gallons; density=7.92 lb/gal; batch mass=4,356 lb):

1. Weigh, pump, and dispense 1971.1 lb PAO 10 (SPECTRASYN™ 10) into large 6000-gallon container.
2. Weigh, pump, and dispense 1089 lb DURAD® 310M into PAO 10.
3. Weigh, pump, and dispense 1089 lb NAUGALUBE® APAN into DURAD® 310M and PAO 10.
4. Weigh, pump, and dispense 54.45 lb LUBRIZOL® 859 into NAUGALUBE® APAN, DURAD® 310M, and PAO 10.
5. Weigh, pump, and dispense 108.9 lb Irgamet 39 into LUBRIZOL® 859, NAUGALUBE® APAN, DURAD® 310M, and PAO 10.
6. Weigh and dispense 10.89 lb Unisol Red BHF into Irgamet 39, LUBRIZOL® 859, NAUGALUBE® APAN, DURAD® 310M, and PAO 10.
7. Weight and dispense 32.67 lb FOAM BAN® 152 into red dye, Irgamet 39, LUBRIZOL® 859, NAUGALUBE® APAN, DURAD® 310M, and PAO 10.
8. Mix at 50° C. to 60° C. for 30 min until uniform.

2190-S(NS) Finished Product Procedure (assume batch volume=10,000 gallons; density=7.92 lb/gal; batch mass=79,200 lb):

1. Weigh, pump, and dispense 67,961.5 lb PAO 10 (~83.776 wt %) (SPECTRASYN™ 10) into two large 6000-gallon containers.
2. Weigh, pump, and dispense 9504.0 lb PAO 40 (~12 wt %) (SPECTRASYN™ 40) into PAO 10.
3. Weigh and dispense 1734.5 lb Additive Concentrate (2.190 wt %) into the PAO 40 and PAO 10.
4. Mix at room temperature for several hours until uniform.

Example 2—Evaluation of Lubricating Compositions Comprising Non-Silicone Anti-Foaming Agents Against MIL-DTL-32353A Specification Regarding Foaming Characteristics (ASTM D892) and Comparison to 2190-S Lubricating compositions comprising non-silicone anti-foaming agents (hereinafter, the "non-silicone lubricating compositions") were evaluated against the MIL-DTL-32353A w/AMENDMENT 1 (16 Feb. 2021) requirement of <65 mL of foam. The non-silicone lubricating compositions were also compared to the commercial METSS 2190-S formulation. METSS 2190-S (Material Engineering Technical Support Services Corp., Westerville, Ohio) is a lubricating composition that comprises a silicone-based anti-foaming agent, namely Xiameter PMX-200 Silicone Fluid, 12500C5. Evaluations were conducted using ASTM D892.

FIG. 1 (Table 1) shows the formulations that were tested.

FIG. 2 (Table 2) shows the results of the ASTM D892 testing. Not all ASTM D892 Sequences were performed for all formulations.

Example 3—Evaluation of Non-Silicone Lubricating Compositions Against Various MIL-DTL-32353A Specifications and Comparison to 2190-S Non-silicone lubricating compositions were evaluated against the MIL-DTL-32353A specifications for Air Release (ASTM D3427), the Rotating Bomb Oxidation Test (RBOT) (ASTM D2272), TAN (ASTM D974), and emulsion requirements (ASTM D1401). In some circumstances, the non-silicone lubricating compositions were compared to the commercial METSS 2190-S formulation. FIG. 3 (Table 3) shows the results.

Example 4—Evaluation of 2190-S(NS) Against Various MIL-DTL-32353A Specifications and Comparison to 2190-S A 250-gallon batch of 2190-S(NS) was prepared for final qualification and testing. This batch of lubricating composition was submitted for testing in accordance with MIL-PRF-32353A. FIGS. 4A-4D (Table 4) show the results.

Blending 2190-S(NS) using FOAM BAN® 152 was facile (in stark contrast to using Xiameter 200 in 2190-S) and use of 2190-S(NS) resulted in no precipitation.

Example 5: Reduction or Removal of Foaming Upon Contacting Synthetic Lubricating Compositions with Mineral-Oil-Based Fluids Foaming occurs when certain synthetic fluids such as "2075-S" formulations are contacted with mineral oil-based fluids, such as 2190-TEP and 2075-T-H. An example of a 2075-S formulation, "2075-S-22," is shown in FIG. 5 (Table 5).

With reference to FIG. 6 (Table 6), 2075-S-22 does not contain and does not require an anti-foaming agent when used alone (unlike the 2190-S formulations). However, when 2075-S-22 is contacted with 2075-T-H, foaming occurs (also, unlike the 2190-S formulations). When FOAM BAN® 152 (alone) is added to 2075-S-22, even in significant treatment amounts (reducing the PAO-6 to 98.825%), and the formulation is contacted with 2075-T-H, foaming still occurs. When a surfactant, and more particularly, a mixture of isopropyl triphenyl phosphate and partially esterified $C_8$-$C_{16}$ phosphates (alone) is added to 2075-S-22 (reducing the PAO-6 to 98.85%), and the formulation is contacted with 2075-T-H, foaming still occurs. Indeed, when 0.05% of the mixture of isopropyl triphenyl phosphate and partially esterified $C_8$-$C_{16}$ phosphates (alone) is added to 2075-S-22 alone, foaming begins to occur. However, surprisingly, when the mixture of isopropyl triphenyl phosphate and partially esterified $C_8$-$C_{16}$ phosphates and FOAM BAN® 152 are both added to 2075-S-22 (reducing the PAO-6 to 98.775%), and the formulation is contacted with 2075-T-H, foaming is reduced below the acceptable limit of <65 ml foam required by MIL-PRF-17672E.

There are no extraordinary anti-wear requirements for 2075-S, so 2075-5 has not traditionally comprised a surfactant (e.g., from the DURAD® series). However, a version of 2075-S having extraordinary anti-wear characteristics as disclosed and claimed herein is highly desirable, especially where, as here, the improved 2075-S formulation can be blended with existing mineral oil-based synthetic fluids such as 2075-T-H without unacceptable foaming.

Example 6—Preparation of Mineral Oil-Based Lubricating Compositions Comprising Non-Silicone Anti-Foaming Agents and Evaluation Against Various Requirements of MIL-DTL-17331L Specification Mineral Oil-Based lubricating compositions comprising non-silicone anti-foaming agents were prepared. One of the compositions was evaluated against various requirements of the MIL-DTL-17331L Specification. FIG. 7 (Table 7) shows the formulations that were prepared. FIGS. 8A-8B (Table 8) show the results of the testing.

What is claimed is:

1. A lubricating composition, comprising:

(A) a base oil component, comprising: a polyalphaolefin ("PAO"), a mineral oil, or both, and comprising from about 95% to about 99.5% w/w of the lubricating composition; and (B) an additive component, consisting essentially of:

(1) an anti-wear agent selected from the group consisting of: a $C_3$-$C_6$ alkylated triarylphosphate, a $C_4$-$C_{18}$ alkyl phosphate, a diarylether phosphate ester, a diarylether phosphate diester diphosphate, or a mixture thereof, (2) an aryl amine antioxidant agent selected from the group consisting of a phenyl alpha naphthyl amine, alkylated phenyl alpha naphthyl amine, or a mixture thereof, (3) a metal deactivating agent comprising a tolyl triazole derivative, (4) an anti-rust agent selected from the group consisting of an alkyl succinic acid ester, an alkenyl succinic acid ester, or a mixture thereof, and, optionally, (5) a soluble red dye, and, (6) a non-silicone anti-foaming agent comprising an acrylate and/or a polyacrylate, wherein the acrylate and/or polyacrylate consists of one or more non-fluorinated acrylate and/or one or more non-fluorinated polyacrylate, wherein, the additive component comprises from about 0.5% to about 5% w/w of the lubricating composition.

2. The lubricating composition of claim 1, wherein the base oil component comprises from about 80% to about 90% of a first PAO having a kinematic viscosity of about 10 centiStokes at 100° C. and from about 10% to about 15% of a second PAO having a kinematic viscosity of about 40 centiStokes at 100° C.

3. The lubricating composition of claim 1, wherein the non-silicone anti-foaming agent is present and comprises from about 0.01% to about 0.1% w/w of the lubricating composition.

4. The lubricating composition of claim 1, wherein the anti-wear agent comprises from about 0.05% to about 2% w/w of the lubricating composition.

5. The lubricating composition of claim 1, wherein the aryl amine antioxidant comprises from about 0.1% to about 2% w/w of the lubricating composition.

6. The lubricating composition of claim 1, wherein the anti-rust agent comprises from about 0.01% to about 0.1% w/w of the lubricating composition.

7. The lubricating composition of claim 1, wherein the metal deactivating agent comprises from about 0.025% to about 0.5% w/w of the lubricating composition.

8. The lubricating composition of claim 1, wherein the red dye is present.

9. The lubricating composition of claim 2, wherein:

the PAO 10 is present in an amount of about 85.8 wt %;

the PAO 40 is present in an amount of about 12 wt %;

the non-silicone anti-foaming agent is present and comprises a polyacrylate polymer in the amount of about 0.030 wt %;

the anti-wear agent is a mixture of isopropyl triphenyl phosphate and partially esterified C8-C16 phosphates and is present in an amount of about 1 wt %;

the aryl amine antioxidant agent is an alkylated phenyl alpha naphthyl amine and is present in an amount of about 1 wt %;

the metal deactivating agent comprising a tolyl triazole derivative is present in an amount of about 0.1 wt %;

the anti-rust agent is a butanedioic acid, (tetrapropenyl)-, ester with 1,3-propanediol and is present in an amount of about 0.05 wt; and the red dye is present and comprises about 0.01 wt %.

10. The lubricating composition of claim 1, wherein the base oil component comprises a first mineral oil having a kinematic viscosity of about 11 to about 13 centiStokes at 100° C. and a second mineral oil having a kinematic viscosity of about 4 to about 5 centiStokes at 100° C.

11. The lubricating composition of claim 10, wherein:
the first mineral oil and the second mineral oil are present in a total amount of about 98.5 wt %.

12. The lubricating composition of claim 11 wherein:
the non-silicone anti-foaming agent is present and comprises a polyacrylate polymer in the amount of about 0.030 wt %;
the anti-wear agent is a mixture of isopropyl triphenyl phosphate and partially esterified C8-C16 phosphates and is present in an amount of about 1 wt %;
the aryl amine antioxidant agent is an alkylated phenyl alpha naphthyl amine and is present in an amount of about 0.25 wt %;
the metal deactivating agent comprising a tolyl triazole derivative is present in an amount of from about 0.1 wt % to about 0.3% wt %; and
the anti-rust agent is a butanedioic acid, (tetrapropenyl)-, ester with 1,3-propanediol and is present in an amount of about 0.05 wt %.

13. A lubricating composition, comprising:
(A) a base oil component, comprising: a polyalphaolefin ("PAO"), a mineral oil, or both, and comprising from about 95% to about 99.5% w/w of the lubricating composition; and
(B) an additive component, consisting essentially of:
(1) an anti-wear agent selected from the group consisting of: a $C_3$-$C_6$ alkylated triarylphosphate, a $C_4$-$C_{18}$ alkyl phosphate, a diarylether phosphate ester, a diarylether phosphate diester diphosphate, or a mixture thereof,
(2) an aryl amine antioxidant agent selected from the group consisting of a phenyl alpha naphthyl amine, alkylated phenyl alpha naphthyl amine, or a mixture thereof,
(3) a metal deactivating agent comprising a tolyl triazole derivative,
(4) an anti-rust agent selected from the group consisting of an alkyl succinic acid ester, an alkenyl succinic acid ester, or a mixture thereof, and, optionally,
(5) a soluble red dye, and,
(6) a non-silicone anti-foaming agent consisting essentially of a non-fluorinated acrylic copolymer and petroleum distillates and, optionally, 2-methyl-3-isothiazlone and/or benzene, 1,1'-oxybis-, tetrapropylene derivatives, sulfonated, sodium salts,
wherein, the additive component comprises from about 0.5% to about 5% w/w of the lubricating composition.

14. The lubricating composition of claim 13, wherein the base oil component comprises from about 80% to about 90% of a first PAO having a kinematic viscosity of about 10 centiStokes at 100° C. and from about 10% to about 15% of a second PAO having a kinematic viscosity of about 40 centiStokes at 100° C.

15. The lubricating composition of claim 13, wherein the non-silicone anti-foaming agent is present and comprises from about 0.01% to about 0.1% w/w of the lubricating composition.

16. The lubricating composition of claim 13, wherein the anti-wear agent comprises from about 0.05% to about 2% w/w of the lubricating composition.

17. The lubricating composition of claim 13, wherein the aryl amine antioxidant comprises from about 0.1% to about 2% w/w of the lubricating composition.

18. The lubricating composition of claim 13, wherein the anti-rust agent comprises from about 0.01% to about 0.1% w/w of the lubricating composition.

19. The lubricating composition of claim 13, wherein the metal deactivating agent comprises from about 0.025% to about 0.5% w/w of the lubricating composition.

20. The lubricating composition of claim 13, wherein the red dye is present.

21. The lubricating composition of claim 14, wherein:
the PAO 10 is present in an amount of about 85.8 wt %;
the PAO 40 is present in an amount of about 12 wt %;
the non-silicone anti-foaming agent is present and comprises a polyacrylate polymer in the amount of about 0.030 wt %;
the anti-wear agent is a mixture of isopropyl triphenyl phosphate and partially esterified C8-C16 phosphates and is present in an amount of about 1 wt %;
the aryl amine antioxidant agent is an alkylated phenyl alpha naphthyl amine and is present in an amount of about 1 wt %;
the metal deactivating agent comprising a tolyl triazole derivative is present in an amount of from about 0.1 wt % to about 0.3 wt %;
the anti-rust agent is a butanedioic acid, (tetrapropenyl)-, ester with 1,3-propanediol and is present in an amount of about 0.05 wt; and
the red dye is present and comprises about 0.01 wt %.

22. The lubricating composition of claim 13, wherein the base oil component comprises a first mineral oil having a kinematic viscosity of about 11 to about 13 centiStokes at 100° C. and a second mineral oil having a kinematic viscosity of about 4 to about 5 centiStokes at 100° C.

23. The lubricating composition of claim 22, wherein:
the first mineral oil and the second mineral oil are present in a total amount of about 98.5 wt %.

24. The lubricating composition of claim 23 wherein:
the non-silicone anti-foaming agent is present and comprises a polyacrylate polymer in the amount of about 0.030 wt %;
the anti-wear agent is a mixture of isopropyl triphenyl phosphate and partially esterified C8-C16 phosphates and is present in an amount of about 1 wt %;
the aryl amine antioxidant agent is an alkylated phenyl alpha naphthyl amine and is present in an amount of about 0.25 wt %;
the metal deactivating agent comprising a tolyl triazole derivative is present in an amount of about 0.1 wt %; and
the anti-rust agent is a butanedioic acid, (tetrapropenyl)-, ester with 1,3-propanediol and is present in an amount of about 0.05 wt %.

* * * * *